United States Patent [19]

Prock

[11] 4,299,183

[45] Nov. 10, 1981

[54] METHOD FOR MOORING A VESSEL TO A PIER OR DOCK

[75] Inventor: David A. Prock, Salem, Oreg.

[73] Assignee: Texaco Inc., White Plains, N.Y.

[21] Appl. No.: 1,243

[22] Filed: Jan. 5, 1979

[51] Int. Cl.[3] ..... B63B 21/00

[52] U.S. Cl. ..... 114/230; 114/218

[58] Field of Search ..... 114/218, 230, 293, 253, 114/254, 101; 254/190 R; 248/291, 81; 24/115 R

[56] References Cited

U.S. PATENT DOCUMENTS

| | | | |
|---|---|---|---|
| 533,193 | 1/1895 | Granger | 24/115 R |
| 1,402,496 | 1/1922 | Hoffman | 114/218 |
| 1,945,423 | 1/1934 | DePass | 248/81 |
| 3,126,858 | 3/1964 | Rosinski | 114/218 |
| 3,424,412 | 1/1969 | Gayle | 248/291 |
| 3,507,243 | 4/1970 | Brown | 114/218 |
| 3,585,959 | 6/1971 | Cook | 114/230 |
| 3,664,637 | 5/1972 | Troiano | 254/190 R |
| 3,892,386 | 7/1975 | Hogan | 114/254 |
| 3,935,829 | 2/1976 | Lantz | 114/293 |
| 4,173,194 | 11/1979 | McLaughlin | 114/218 |

*Primary Examiner*—Trygve M. Blix
*Assistant Examiner*—D. W. Keen
*Attorney, Agent, or Firm*—Carl G. Ries; Robert A. Kulason; Robert B. Burns

[57] ABSTRACT

Method for mooring a vessel to a dock by at least one cable, wherein a displaceable cable guide is provided on the dock to receive a cable messenger line. When the cable has been guidably drawn to the dock and the end thereof fastened to a mooring post, the cable guide is displaced thereby to free the cable, which can now be tensioned.

4 Claims, 4 Drawing Figures

METHOD FOR MOORING A VESSEL TO A PIER OR DOCK

BACKGROUND OF THE INVENTION

During the docking of any large vessel, such as a greighter, fluid carrying tanker or the like, a number of elements combine to complicate the operation. Among such problems is the velocity of the wind acting against the vessel, the flow of the water about the vessel's hull with respect to the mooring facility, and the momentum of the vessel through the water. Further, the hull is often so large and unwieldy that it becomes difficult to maneuver it sufficiently close to a dock or pier that it can be readily made fast.

The normal procedure for mooring or docking a vessel of this type is that the mooring cables are carried to the pier from the vessel. The ends can then be fixed to an appropriate mooring or docking post.

Because these mooring cables are relatively heavy and cumbersome the practice is that a relatively light messenger line is initially passed either from the vessel to the shore, or vice versa. The cable is then fastened to one end of the messenger line such that the heavy cable can be hauled across the space between the vessel and the dock.

As the end of the cable is brought dockside it is looped onto the fastening means. Thereafter the crew of the vessel, by taking up the mooring line from the vessel, can controllably bring the latter into contact with the pier.

To lessen the physical impact against any pier the latter is normally provided with one or more spaced apart, resilient bumpers. These members are designed to absorb some of the shock of the massive vessel as it contacts the pier.

A particular problem associated with such a mooring operation is the weight of the normal mooring lines or cable which are at best cumbersome. Thus, the vessel cannot be accurately aligned with respect to its proper or ultimate mooring position. The messenger line must therefore serve the purpose of pulling the heavy cable along the dock edge until it can be looped onto its proper mooring post.

Toward minimizing the problem of bringing a vessel safely and readily to a pier, the present invention is provided. It is addressed particularly to a method for facilitating a docking operation while minimizing the possibility of damage to either vessel or pier. This is achieved by providing a cable guide means on the pier or dock, that can be provisionally positioned to receive both a messenger line and thereafter a mooring line. After the looped end of the latter has been secured about a post or the like, the cable guide is collapsed or displaced, thereby quickly releasing the cable so that tension can be applied to the latter without damage to the guide means.

It is therefore an object of the invention to provide a method for simplifying the docking of large vessels. A still further object is to provide a vessel docking method whereby heavy mooring lines are guidably brought ashore from the vessel to the dock.

DESCRIPTION OF THE DRAWINGS

Referring to FIG. 1, a vessel 10 which utilizes the presently disclosed cable guide means 11, is shown positioned adjacent to, but as yet unfastened to a pier 12. Vessel 10 is normally brought to a standstill in the water as close as possible to the pier 12 such that mooring lines 13 and 14 which extend from the bow and the stern, can be safely carried onto the pier. This, as above noted, can be achieved by towing a messenger line from the pier to the vessel, or vice versa.

Figure 1:
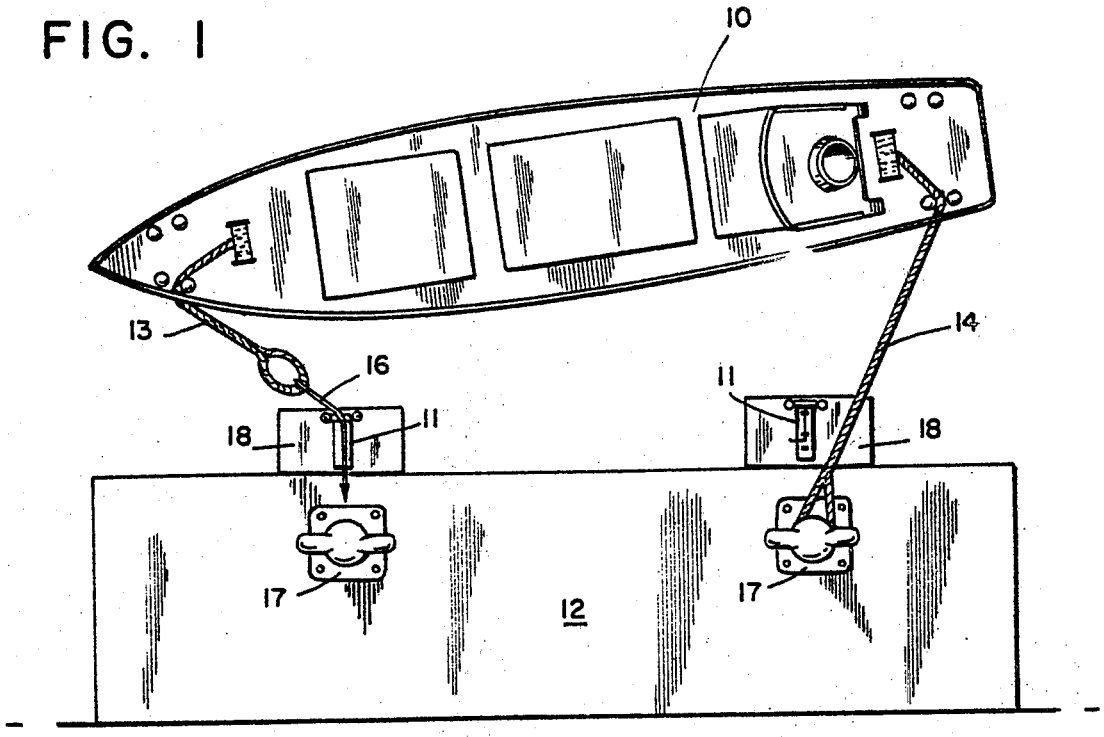
FIG. 1 illustrates an environmental sketch of a vessel of the type contemplated being aligned in position to be moored or fastened to a dock.
Figure 3:
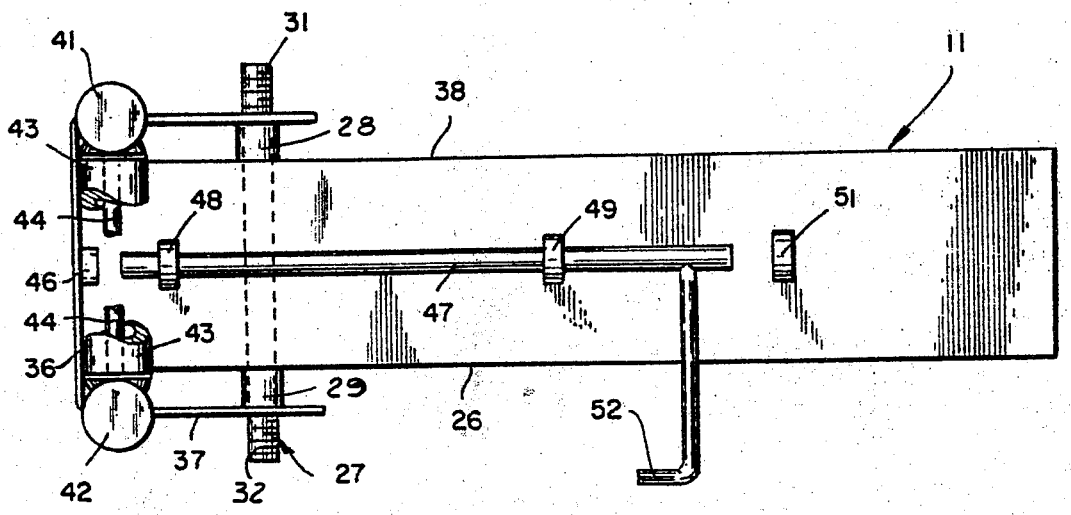
FIG. 3 is a top view of FIG. 2.
Figure 4:
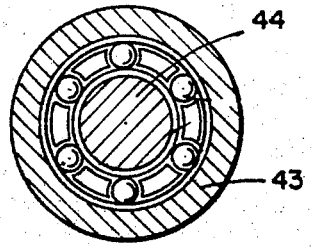
FIG. 4 is a cross sectional view taken along line 4—4 of FIG. 2.

In either instance the remote end of the mooring line 13 for example, normally incorporates an enlarged loop, and is fastened to the end of the messenger line 16 on vessel 10. Thereafter, messenger line 16 is drawn manually onto dock 12 until the looped end of the line is in position to be connected to a mooring post 17.

It is difficult as mentioned, to accurately position vessel 10, particularly in the instance of relatively large and loaded tankers which are virtually uncontrollable when brought into mooring position. It is often in fact necessary to haul the mooring cables by boat or launch a relatively great distance before they can be properly attached to mooring post 17.

Figure 2:
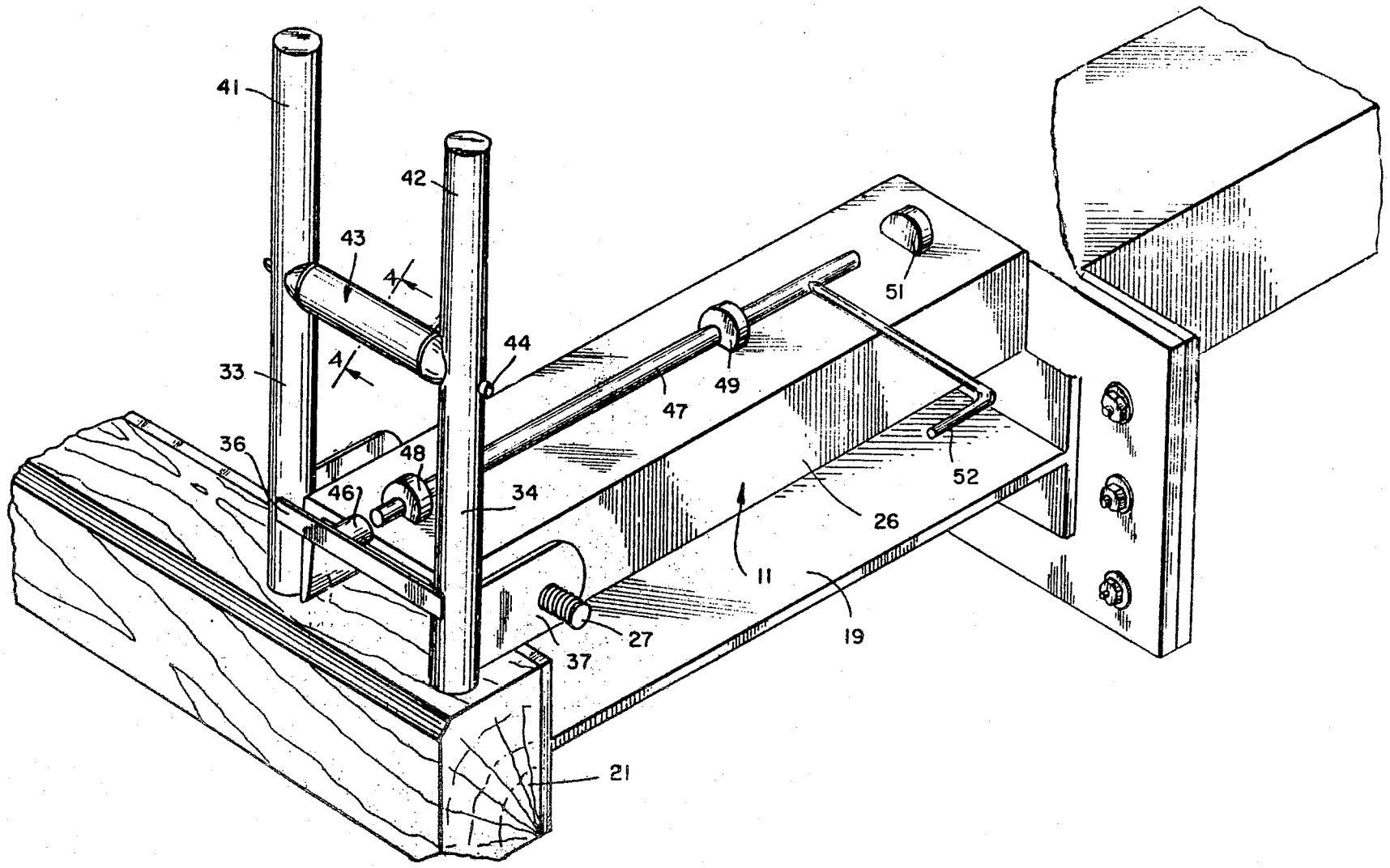
FIG. 2 is an enlarged isometric view of a cable guide of the type contemplated one or more of which are normally carried along the dock.

Referring to FIG. 2, mooring cable guide 11 is normally positioned at the edge of a pier or dock 12 adjacent to the edge of the latter and also adjacent to or in the vicinity of a mooring post 17. The cable guide as particularly shown can be firmly fixed to a fender 18 or similar shock absorber which protrudes from the dock. Said fender is so positioned to engage the side of the vessel's hull as the latter floats or is drawn into contact with the dock 12. Fender 18, or bumper, as it is often referred to, is so designed to take up and minimize shock which might otherwise be applied to the fixedly positioned dock.

In the present arrangement fender 18 is shown as comprising in part a wide flanged steel beam 19 which extends outwardly from the dock 12. A relatively resilient member 21 such as a strip of wood or rubber at the edge thereof first engages the boat's hull.

Cable guide assembly 11, includes an elongated base 26 in the form of a structural member such as a U-shaped channel or the like. The latter is arranged with its broad planar surface in an upward direction. The base member 26 is of sufficient length, normally two to three feet long, and approximately twelve inches wide depending on the size and character of the vessel to be accommodated. The inner end of said base 26 is firmly engaged to the wide flanged beam 19 preferably by welding, although a bolted joint can be also utilized.

The remote end of base 26 is provided with a transverse shaft 27 which extends therethrough. Said shaft includes a plurality of washers 28 and 29 carried on the respective shaft ends adjacent the outwardly protruding threaded shaft ends 31 and 32.

The cable guide assembly 11 further includes a pair of substantially parallel spaced apart posts 33 and 34. The lower ends of each post are connected by a lock plate 36. The lower end of each post is further provided with a rearwardly extending hinge plate 37 and 38, the latter being aligned to register with shaft 27. The movable post unit is operably maintained in place by nuts carried on the respective shaft 27 ends while permitting the entire assembly to be partially rotated about the shaft 27 in a substantially vertical plane.

The upper ends of the respective spaced apart, parallel posts 33 and 34 are arranged to provide two extending arms 41, and 42. Said arms define a U-shaped or open ended aperture therebetween for receiving a moving messenger line 16, as well as a cable 13. The lower end of the open ended aperture includes a roller means 43 having a bearing 45 carried at each end thereof adapted to be journalled to a shaft 44. Said shaft 44 extends transversely of the respective posts 33 and 34, being firmly anchored to each. Thus, the U-shaped aperture formed between arms 41 and 42 permits free, yet supported passage of the messenger line 16 as well as mooring cable 13.

Lock plate 36 is provided with a receptacle 46 which extends inwardly toward base member 26. The latter is provided with an elongated locking rod 47 which is slidably positioned by spaced apart rod guides 48 and 49. Said rod guides comprise a surface to slidably register locking rod 47 to thereby permit the latter a degree of longitudinal movement.

Said longitudinal movement is controlled by a lock rod stop 51 fastened to the base 26. A laterally protruding handle 52 is positioned to facilitate manipulation, of the rod as needed, between the engaged and disengaged position with locking rod 47.

In the locked position as shown, and with the cable guide 11 in the upper or engaged position, lock rod 47 is adjusted to register the remote tip thereof with receptacle 46. Thus, the upstanding U-shaped cable guide segment is restrained from further movement. However, with lock rod 47 withdrawn, the fixed connection between the cable guide and the base member 26 will be discontinued. The cable guide can now be pivotally moved or adjusted. It is thus free to move or be retracted into substantial parallel relationship with base 26.

Operationally, when a vessel 10 is to be moored to a dock 12, messenger line 16 will be fixed to the looped end of mooring cable 13. As the messenger line 16 is drawn from the vessel by personnel on the dock, said line is dropped into the upstanding guide aperture defined between the parallel arms 41 and 42. Messenger line 16 can now rest on rollers 43 as the line is drawn from the vessel 10 onto dock 12.

Mooring cable 13 will likewise follow the messenger line 16 into the mooring cable aperture, and similarly be drawn while supported on the transverse roller 43. When sufficient cable is drawn in, the looped end is placed onto the adjacent mooring post 17. In such a position vessel 10 will normally be so positioned that it will have to be drawn in toward pier 12. Further, it will be laterally displaced from the pier and consequently tension will have to be applied to the mooring cables 13 and 14 to pull the vessel either forward or to the rear.

However, prior to tension being applied to the slack mooring lines 13 and 14, lock rod 47 is withdrawn from receptacle 46 to release the upstanding cable guide assembly. When so released said assembly can be pivotally adjusted into a downward position contiguous with base 26. During this movement, cable 13 will be freed from the confines of upstanding arms 41 and 42. With the cable guide displaced, tension can be applied to the freed cables whereby to pull the vessel in as required.

To facilitate the release of cable 13, the guide assembly can be provided with a partial enclosure. The latter is formed by opposed end plates 56 and 57, which are joined to a back plate 58. Thus, when the cable confining arms 41 and 42 are lowered, the released cable will be supported on the upper, slanted edge of either plate 56 or 57. Thereafter when tension is applied to the cable, there will be no opportunity for it to damage the moving parts of the guide apparatus.

Other modifications and variations of the invented method as hereinbefore set forth can be made without departing from the spirit and scope thereof, and therefore, only such limitations should be imposed as are indicated in the appended claims.

I claim:

1. Method for mooring a vessel to a pier by means of at least one mooring cable which extends between the vessel and the mooring post on the pier, which method includes the steps of;

providing a remote end of said mooring cable with a relatively light messenger line, providing a mooring cable guide apparatus on said pier including an upstanding messenger line guide means having spaced apart arms which define an aperture adapted to guidably receive the messenger line, and which messenger line guide means is pivotally adjustable between upstanding and lowered positions, positioning the messenger line between the spaced apart arms of the guide means, guidably drawing said messenger line and the mooring cable from the vessel thereby to engage said mooring cable with said mooring post, adjusting the messenger line guide means to a lowered position to displace the messenger line and mooring cable from between the spaced apart arms.

2. In the method as defined in claim 1, including the step of; locking said messenger line guide means in the upright position prior to registering the messenger line between the spaced apart guide arms therein.

3. In the method as defined in claim 2, including the step of; unlocking said messenger line guide means prior to pivotally adjust the same to the lowered position.

4. In the method as defined in claim 1, wherein said messenger line guide means includes a U-shaped aperture having an open upper end whereby to receive a messenger line therein, said messenger line guide means being pivotally engaged at the lower end thereof, and pivoting said messenger line guide means to the line releasing position whereby to displace the messenger line from the open end thereof.

* * * * *